United States Patent [19]

Metz et al.

[11] Patent Number: 4,749,026

[45] Date of Patent: Jun. 7, 1988

[54] DEVICE FOR STIRRING MOLTEN METAL IN A CONTINUOUS CASTING PLANT

[75] Inventors: Paul Metz, 18 rue J.P., Brosseur, Luxembourg, L-1258; Paul Kirsch, Abbe Jos Keup, Luxembourg

[73] Assignee: Paul Metz, Luxembourg

[21] Appl. No.: 848,412

[22] Filed: Apr. 4, 1986

[30] Foreign Application Priority Data

Apr. 10, 1985 [LU] Luxembourg ..... 85846

[51] Int. Cl.[4] ..... B22D 27/02

[52] U.S. Cl. ..... 164/504; 164/147.1

[58] Field of Search ..... 164/502, 504, 466, 468, 164/499, 500, 147.1; 222/594; 266/234; 366/273, 274

[56] References Cited

U.S. PATENT DOCUMENTS

| | | | |
|---|---|---|---|
| 2,743,492 | 5/1956 | Easton | 164/502 |
| 3,757,846 | 9/1973 | Herman, Jr. | 164/499 |
| 4,243,092 | 1/1981 | Hanas | 164/504 X |

FOREIGN PATENT DOCUMENTS

| | | | |
|---|---|---|---|
| 2834305 | 2/1980 | Fed. Rep. of Germany | 164/504 |
| 2944760 | 5/1981 | Fed. Rep. of Germany | 164/468 |
| 2006068 | 5/1979 | United Kingdom | 164/504 |

*Primary Examiner*—Kuang Y. Lin

*Attorney, Agent, or Firm*—Fishman, Dionne & Cantor

[57] ABSTRACT

A device for stirring molten metal in a continuous casting operation in which the molten metal flows in a controlled manner from a reservior, via a spout, to an ingot mold is presented. The stirring device comprises an electro-magnetic inductor which is displaceable transversely in relation to the metal casting line with its magnetic core consisting of a unitary part with several arms arranged around the casting line at a distance from the latter and directed radially inwardly towards the casting line. In accordance with a first embodiment of the present invention, the core has three arms which are each provided with an electromagnetic winding and which form, between them, angles of 120°. The inductor is preferably arranged around the spout, but similar inductors may be arranged around the casting line in the secondary cooling zone.

15 Claims, 3 Drawing Sheets

DEVICE FOR STIRRING MOLTEN METAL IN A CONTINUOUS CASTING PLANT

BACKGROUND OF THE INVENTION

The present invention relates to a device for stirring molten metal in a continuous casting operation in which the molten metal flows in a controlled manner from a reservoir, via a spout, to an ingot mold. More particularly, this invention relates to a molten metal stirring device including at least one electromagnetic inductor comprising a magnetic core and windings and designed to induce a rotational movement in the molten metal.

A device of the type hereinabove described is known from document EP-A No. 0,093,068. Electromagnetic stirring, as disclosed in EP-A No. 0,093,068 has been successfully used. The main advantages of electromagnetic stirring are that not only can the spouts be cleaned should they become clogged up; but also, it is possible to prevent slag and inclusions floating on the surface of the metal bath from being sucked in by the whirlpools which form during continuous casting. This is particularly true when the electromagnetic stirring device is applied inside the ingot mold or immediately below the ingot mold. In order to monitor correct cleaning of the spouts, an inductor operating system is used which is connected both to the system controlling the rate at which the ingot mold is fed with liquid metal and to the system monitoring the level of the metal inside the ingot mold. Thus, when this metal level falls (which is automatically compensated for by an increase in the feed rate), and when it is noticed that this compensating operation can be performed only with difficulty, it is possible to conclude that the spout has become clogged.

The document GB-A No. 2,024,679 corresponding to U.S. Pat. No. 4,256,165 describes another stirring device comprising one or more electromagnetic inductors which are mounted on movable crossbeams and which can be retracted when it is advantageous to perform casting without stirring. However, this device does not have the efficiency and output of the powerful single-core inductor described in EP-A No. 0,093,068 (which surrounds the molten metal and is capable of inducing a rotational field in the metal).

The document GB-A No. 2,006,068 disclosed a multipolar inductor which comprises several poles extending perpendicularly from a single core and which allows a casting line to be approached on one side only, despite the presence of feed rollers which, in the operating position, are located between the poles of the inductor. However, this inductor can only exert a unilateral effect because it does not allow the casting line to be accessed through 360°.

SUMMARY OF THE INVENTION

The above discussed and other problems and deficiencies of the prior art are overcome or alleviated by the molten metal stirring device of the present invention which combines the advantages of the known devices described above.

The stirring device of the present invention comprises an electro-magnetic inductor which is displaceable transversely in relation to the metal casting line with its magnetic core consisting of a unitary part with several arms arranged around the casting line at a preselected distance from the latter and directed radially inwardly towards the casting line.

In accordance with a first embodiment of the present invention, the core has three arms which are each provided with an electromagnetic winding and which form, between them, angles of 120°. The inductor is preferably arranged around the spout, but similar inductors may be arranged around the casting line in the secondary cooling zone. The minimum distance between the arms of the inductor is greater than the external diameter of the spout so as to allow the inductor to be engaged or retracted. In order to facilitate disengagement of the inductor in relation to the spout, one of the arms of the core may be connected to the remainder of the latter by means of a hinge, thereby allowing this arm to be swung back. The three arms of the core may be arranged in staggered fashion around the spout, thus causing helical rotation in the molten metal. In order to prevent stray currents between the adjacent arms of the core, each of the three arms has, on its inner side, a short-circuit winding.

In accordance with another embodiment of the present invention, the core has only a single electromagnetic winding and two arms, the ends of which are designed, by means of an axial slot, in the form of a fork with two prongs, and wherein one prong of one arm and the diametrically opposite prong of the other arm have a short-circuit winding.

The improvements represented by the stirring device of the present invention, relative to the prior art, include the fact that the inductor is no longer in contact with the spout or the casting line; and also that the inductor may be retracted if necessary. The advantage resulting therefrom is that the electrical portion of the inductor may be arranged outside the hot zone, thereby simplifying its design and eliminating or facilitating cooling of the inductor. Moreover, the inductor of the instant invention does not hinder access to the spout and the ingot mold, thereby making it easier to monitor the casting operation and introduce metallurgical additives and mixtures into the ingot mold.

It will also be appreciated that because the core comprises a single unitary part, the arms of which are oriented radially towards the casting line, a very powerful rotational field may be created.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
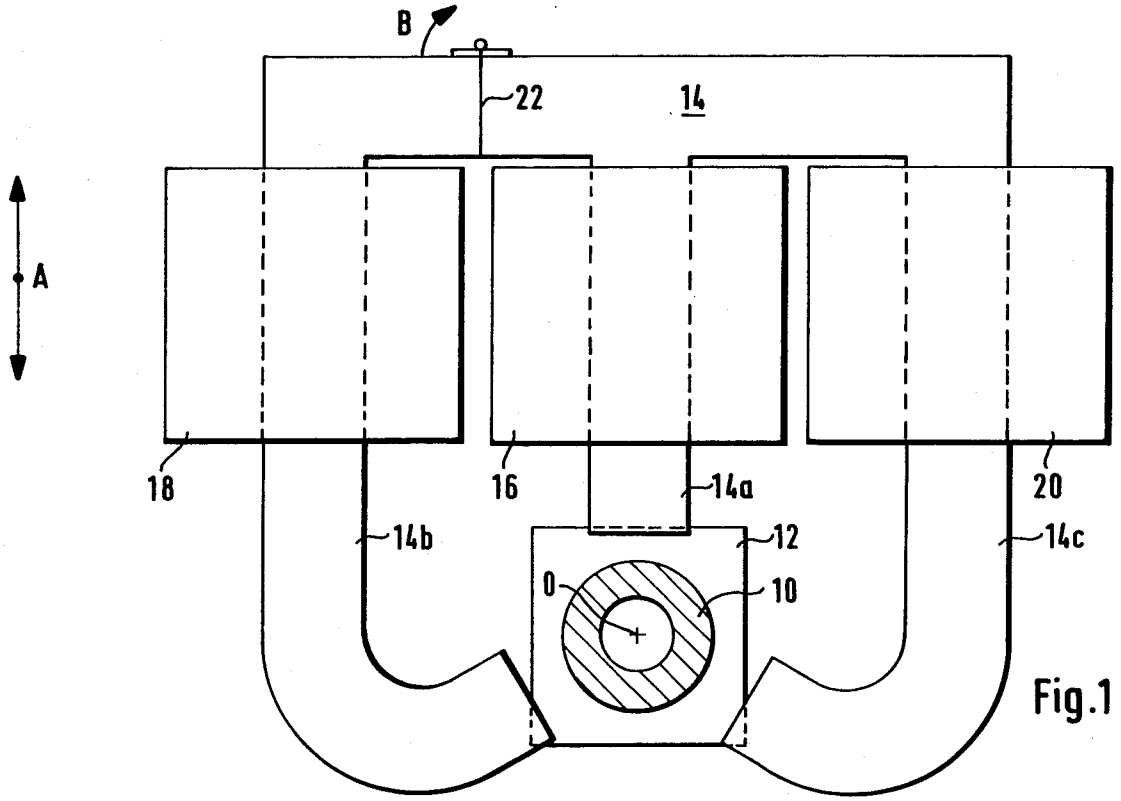
FIG. 1 is a plan view of an electromagnetic inductor in accordance with the present invention.

A spout 10 of the type described in document EP-A No. 0,093,068 is shown at 10 in FIG. 1. Spout 10 is arranged perpendicularly to the plane of FIG. 1. Spout 10 is located between a continuous casting ladle (not shown) and a continuous casting ingot mold, indicated generally at 12. The flow of molten metal through spout 10 is regulated so that the bottom portion of the spout is located below the level of the metal bath and so that, as a result, it is permanently immersed during casting. It will be appreciated that no further discussion of the spout and operation of the stirring device is necessary as EP-A No. 0,093,068 fully describes this subject and should be referred to for further information. Significantly, the electromagnetic inductor described in EP-A No. 0,093,068 has a cylindrical shape and is arranged coaxially around the spout.

In a first embodiment, the electromagnetic inductor of the present invention has a magnetic core 14 with three arms 14*a*, 14*b* and 14*c*, having the general configuration of a letter E. The ends of the two outer arms 14*b* and 14*c* are curved in the direction of the middle arm so that the axes of the three arms 14*a*, 14*b* and 14*c* have a common point or axis of intersection O opposite the middle arm 14*a*. The three arms are, in addition, arranged symmetrically around the axis O, i.e. they form between them angles of 120°. Respective electromagnetic windings 16, 18 and 20 are arranged around each of the arms 14*a*, 14*b* and 14*c* of the core as shown in FIG. 1.

In the operating position, the inductor is arranged around the spout 10 so that the axis O coincides with the central axis of the spout 10. However, in accordance with an important feature of the present invention, the inductor is displaceable transversely in relation to spout 10, this transverse movement being indicated by the arrow A. Core 14 can be mounted, for this purpose, on a movable carriage (not shown).

In order to engage or disengage the inductor from around spout 10, it is necessary for the distance between arms 14*b* and 14*c* to be greater than the diameter of spout 10. If for some reason this spacing requirement were not possible, or, by way of a measure for facilitating engagement and disengagement of the inductor, core 14 may be provided with a hinge 22 so that one of the outer arms 14*b* or 14*c* can be pulled out. Hinge 22 may be provided in the location indicated in FIG. 1, so as to allow arm 14*b* to be swung back in the direction of the arrow B. Alternatively, arm 14*b* may be provided in the region of the bend in the arm 14*b*.

The inductor of FIG. 1 functions in the manner of an electric motor, the three windings 16, 18 and 20 being connected to a three-phase alternating current, while the liquid metal column in the spout 10 acts as a rotor.

The frequency of the alternating current supplying windings 16, 18 and 20 is normally that of the mains supply. However, it is preferable to provide means which allow the frequency to be reduced, particularly when the product to be processed has a low magnetic permeability (which is often the case when the stirring device is used in the secondary cooling zone). When it is also required to heat the liquid metal, a frequency higher than the frequency of the mains supply may be used. Although it is preferable to provide a three-phase system, it is possible to perform stirring by means of a two-phase system, i.e. a magnetic core with two opposite arms.

It is not necessary for arms 14*a*, 14*b* and 14*c* to be arranged on the same level, i.e. so that their axes are coplanar. On the contrary, arms 14*a*, 14*b* and 14*c* may be arranged in staggered fashion around spout 10, thus enabling a helical rotational movement to be created in the metal bath.

In some cases, it may be preferable to perform asymmetrical stirring in relation to the axis of the cast product, particularly in the secondary cooling zone. This asymmetrical stirring action may be obtained by placing the three arms at different distances in relation to the axis of the casting line. It is also possible to have different angles between the three arms of the core which would be preferable under certain operating conditions. Also, in order to intensify stirring, several inductors may be placed next to each other.

Preferred results from the present invention are obtained when all the electro-magnetic lines of force are concentrated between the spout 10 and each of the arms 14*a*, 14*b* and 14*c*. For this purpose, it is preferable to provide means which reduce the stray currents occurring between the middle arm 14*a* and each of the lateral arms 14*b* and 14*c* of the core.

Figure 2:
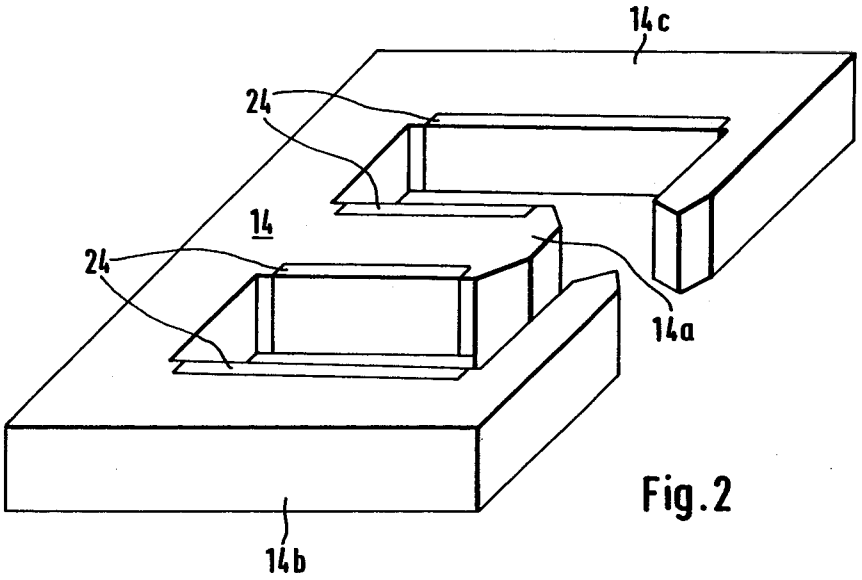
FIG. 2 is a perspective view of another embodiment of the electromagnetic inductor of FIG. 1.

FIG. 2 shows an example of such an embodiment. In FIG. 2 (wherein the windings 16, 18 and 20 of FIG. 1 have not been shown), the adjacent inner sides of the three arms 14*a*, 14*b* and 14*c* have short-circuit turns or windings 24. The stray currents occurring perpendicularly between both the arm 14*a* and the arms 14*b* and 14*c* generate a current in these windings 24, the field of which opposes the stray currents.

It will be appreciated that the windings 24 may be replaced with other suitable means such as, for example, low-resistance metal plates.

Figure 3:
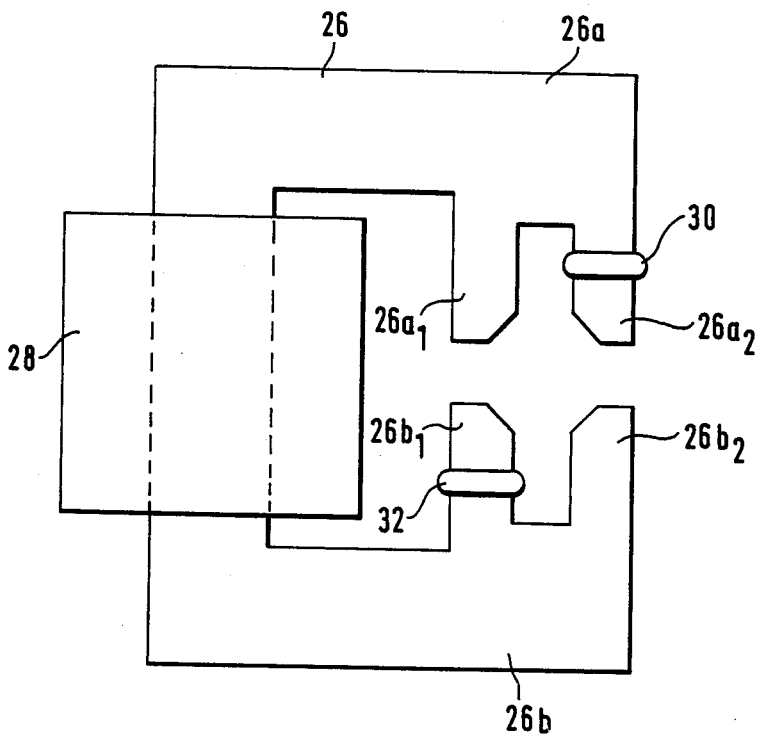
FIG. 3 is a plan view of yet another embodiment of an electromagnetic inductor in accordance with the present invention.

In FIG. 3, another embodiment of an inductor is shown which is designed for smaller plants or plants where there is less room available for the inductor. The inductor of FIG. 3 (which functions using single-phase current), has a magnetic core 26 with two arms 26*a* and 26*b* having the general shape of the letter C (i.e., the middle arm of the embodiment shown in FIG. 1 is missing). Core 26 has only one electromagnetic winding. In order for core 26 to generate a rotational field in the spout (not shown), using single-phase current, but which is located between the ends of arms 26*a* and 26*b*, the latter are configured (by means of an axial slot), in the form of two prongs $26a_1$ and $26a_2$ and $26b_1$ and $26b_2$. The diametrically opposite prongs (i.e. for example, prongs $26a_2$ and $26b_1$), are provided with short-circuit windings 30 and 32. The effect of windings 30 and 32 is that, at a half-phase frequency, the lines of force are established alternately both between the opposite prongs $26a_2$ and $26b_1$ and the opposite prongs $26a_1$ and $26b_2$, so as to generate a rotational field between the four prongs, i.e., in the casting line.

In the embodiment of FIG. 3, the distance between prongs $26a_2$ and $26b_2$ is also greater than the diameter of the spout or, if this design poses problems, one of the arms 26*a*, 26*b* or one of the external prongs $26a_2$, $26b_2$ may be provided with a hinge as in FIG. 1.

It will be appreciated that the several variations discussed with regard to FIG. 1, particularly obtaining stirring action which is asymmetrical or which involves helical rotation may also be provided with the FIG. 3 embodiment.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for stirring molten metal in a continuous casting operation in which the molten metal flows along a casting line in a controlled manner from a reservoir, via a cylindrical spout, to an ingot mold, comprising:

at least one unitary electromagnetic inductor, said inductor including a magnetic core and windings adapted to induce a rotational movement in the molten metal; and wherein said unitary electromagnetic inductor is displaceable transversely in relation to the metal casting line as a single unitary part without any dismantling thereof when removing away from the casting line and wherein said magnetic core has at least two arms arranged about different sides of the casting line, said arms being spaced from the casting line at a preselected distance and wherein said unitary inductor generates an electromagnetic field from different sides of said cylindrical spout.

2. The device of claim 1 wherein:

said electromagnetic inductor is associated with a spout.

3. The device of claim 1 wherein:

a further electromagnetic inductor is associated with the secondary cooling zone of the continuous casting operation.

4. The device of claim 1 wherein:

said core has three arms, the longitudinal axes of each arm being perpendicular to the axis O of the casting line.

5. The device of claim 4 wherein:

said three arms are positioned about 120 degrees apart from each other.

6. The device of claim 4 including:

short-circuit windings arranged on inner adjacent sides of at least one of said three arms of said magnetic core.

7. The device of claim 5 including:

short-circuit windings arranged on inner adjacent sides of at least one of said three arms of said magnetic core.

8. The device of claim 1 wherein:

said magnetic core has only one electromagnetic winding and two arms, said arms having ends which each include an axial slot defining a fork with two prongs; and wherein one of said prongs of one arm and the diametrically opposite prong of the other arm each have a short-circuit winding.

9. The device of claim 4 wherein:

the minimum distance between the ends of said arms of said magnetic core is greater than the external diameter of the casting line.

10. The device of claim 8 wherein:

the minimum distance between the ends of said prongs of said magnetic arms is greater than the external diameter of the casting line.

11. The device of claim 4 wherein:

at least one of said arms of said magnetic core is connected to the remainder of said core by hinge means.

12. The device of claim 8 wherein:

at least one of said prongs of said magnetic core is connected to the remainder of said core by hinge means.

13. The device of claim 4 wherein:

said arms of said magnetic core are arranged in a staggered fashion around the casting line.

14. The device of claim 4 wherein:

said inductor is positioned such that the distances of each of the arms from the axis of the casting line are different from each other.

15. The device of claim 1 wherein:

a plurality of inductors are arranged next to each other.

* * * * *